United States Patent [19]

Bajer et al.

[11] 4,181,083

[45] Jan. 1, 1980

[54] MECHANISM FOR CONTROLLING THE WORKPIECE PRESSURE GRIPPERS OF BUTTONHOLE BAR TACKER SEWING MACHINES

[75] Inventors: Frantisek Bajer; Josef Nejedly; Milos Kral, all of Prostejov, Czechoslovakia

[73] Assignee: Elitex, koncern textilniho strojirenstvi, Liberec, Czechoslovakia

[21] Appl. No.: 435

[22] Filed: Jan. 2, 1979

[30] Foreign Application Priority Data

Dec. 30, 1977 [CS] Czechoslovakia ..... 9052-77

[51] Int. Cl.[2] ..... D05B 3/06; D05B 69/20

[52] U.S. Cl. ..... 112/67; 112/68; 112/70

[58] Field of Search ..... 112/70, 65, 67, 68, 112/76, 158 B, 71, 72, 74

[56] References Cited

U.S. PATENT DOCUMENTS

| | | | |
|---|---|---|---|
| 1,032,621 | 7/1912 | Noble et al. | 112/70 |
| 1,839,854 | 1/1932 | Allen | 112/65 |
| 2,849,971 | 9/1958 | Sweet et al. | 112/76 |
| 2,986,105 | 5/1961 | Maxant | 112/76 |
| 3,039,410 | 6/1962 | Graham et al. | 112/67 |
| 3,274,962 | 9/1966 | Pudelko | 112/65 |

*Primary Examiner*—H. Hampton Hunter

[57] ABSTRACT

There is disclosed mechanism for controlling the workpiece pressure grippers of buttonhole bar tacker sewing machines, such machines having means for selectively cutting the buttonhole either before or after the sewing operation. The controlling mechanism comprises a first disengaging member for controlling the pressure grippers, and a second disengaging member for selectively starting and stopping the machine. The two disengaging members are disposed in the path of rotary motion of at least one part coupled in the motion both with the device for driving the workpiece support plate of the machine and with the cam which controls the cutting knife of the machine.

5 Claims, 11 Drawing Figures

MECHANISM FOR CONTROLLING THE WORKPIECE PRESSURE GRIPPERS OF BUTTONHOLE BAR TACKER SEWING MACHINES

This application is related to the co-assigned application of Bajer et al, U.S. Ser. No. 434, filed Jan. 2, 1979, and Bajer et al U.S. Ser. No. 11, filed Jan. 2, 1979.

The present invention relates to a buttonhole bar tacker sewing machine with a device for cutting the buttonhole according to choice either before or after bar tacking the buttonhole, and a device for automatically lifting the pressure grippers for the workpiece upon the finishing of the buttonhole in both modifications of the sequence of bar tacking and cutting the buttonhole.

Conventional sewing machines operate in such manner that the feeder advances the workpiece continuously in one direction, the successive needle punches thus forming a normal straight seam made up by a row of straight or zigzag stitches. This principle cannot be applied with buttonhole bar tacker sewing machines, as it would be impossible to secure the bar tacking of the required buttonhole shape. Therefore, a support plate is used, the workpiece being stationarily fastened to the support plate by pressing grippers. To the support plate and thus to the pressing grippers there is imparted from a central mechanism a motion the resulting path of which coincides with the required buttonhole shape. The resulting required contour of bar tacking of the buttonhole is formed by a system of zigzag stitches formed by repeated needle punches. The pressing grippers, which are swingably fastened to the support plate, and which thus positively participate in its motion, hold the workpiece in the required position and thus prevent various undesired accidents, such as cutting the buttonhole apart from the longitudinal axis of the bar tacked buttonhole.

Buttonhole bar tacker sewing machines are constructed from the viewpoint of high productivity as semi-automatic machines, which upon starting their operation by manual operation by the attendant perform without any further intervention, i.e., in the preselected sequence, the bar tacking and cutting of the buttonhole, whereupon the operation of the stitch forming mechanism is interrupted in a self-acting manner, the knife being automatically returned into its starting, inactive position. For the purpose of fast advance of the workpiece into the position necessary for bar tacking a further buttonhole, e.g. on the jacket front, it is therefore desirable that the pressing grippers also be automatically lifted and thus make it possible to displace the workpiece immediately after the finishing of the buttonhole, when the machine resumes its starting position.

The manner of operation of the machine of the invention, and the product produced thereby, will be more readily understood by reference to FIG. 1 of the drawings in which a buttonhole is somewhat schematically shown. The buttonhole there shown consists of straight parts a, b; an eye c, and a wedge bar tack d which in turn consists of straight parts $d_1$, $d_2$, and inclined parts $d_3$, $d_4$. Line $d_7$ denotes the point of starting and finishing stitch forming, i.e., the beginning and the end of operation of the stitch forming mechanism of the machine in the course of bar tacking the buttonhole. The line between $d_7$ and $d_{10}$, or possibly $d_{11}$, represents the dead zones of the support plate, i.e., that phase of motion of the pressure plate during which the stitch forming mechanism is already out of action, which is necessary for the machine to take up its basic position and to prepare for bar tacking the following buttonhole.

The line $d_{10}$ represents the initial position of the machine adapted for cutting the buttonhole before bar tacking, whereas line $d_{11}$ represents the initial position of the machine adapted for cutting the buttonhole after bar tacking. In that case, the support plate is transiently stopped on the line $d_{10}$, during its rest the cutting of the buttonhole is performed, and thereupon, during the advancement of the support plate from line $d_{10}$ toward line $d_{11}$, the pressing grippers are lifted. Lines $d_7$, $d_{10}$, $d_{11}$ denote the level of the position of the longitudinal axis of the needle relative to the support plate in the given position of the support plate.

The predominant number of buttonhole bar tacker sewing machines hitherto produced are of a single purpose construction, for cutting either before or after bar tacking, without the possibility of passing over from one modification to the other by adjustment of the machine mechanisms. In these machines, the device for lifting the pressing grippers is coupled with that machine mechanism which performs upon buttonhole sewing the chronologically last operation, i.e., either with the mechanism for cutting the buttonhole in machines in which cutting is performed after bar tacking, or with the bar tacking mechanism in machines in which cutting of the buttonhole is performed before bar tacking the buttonhole.

Machines are known, in which by adjustment of their mechanisms it is possible to change over from cutting before bar tacking to cutting after bar tacking, and vice versa. In these machines, the necessity of lifting the pressure grippers once before reaching line $d_{10}$, in the section between lines $d_{10}$ and $d_{11}$ arises. A single prior device fulfilling that purpose is known to applicants. This device comprises pressing grippers mounted swingably on the support plate, this being a generally applied principle, as the pressing grippers must retain the workpiece to the support plate during its whole motion during which the buttonhole is bar tacked. On the lower side of the support plate there is mounted a mechanism for pressing and lifting pressing grippers, which is connected to a stop which comes into contact with an end stop in the machine adjusted to cutting before bar tacking, thus causing a swinging motion of the pressing grippers into their inactive position, in which the workpiece mounted on the support plate is released from gripping, as soon as the support reaches its initial position denoted by line $d_{10}$. Since bar tacking buttonholes of various lengths, the motion of the support plate is always the same and only the moment is changed at which the stitch forming mechanism is activated, i.e. the position of line $d_7$, so that in dependence upon the required length of the buttonholes there is a longer or shorter complimentary section of the support plate dead zone, the only common adjustment of the mutual position of the stop and the end stop suits the requirement of bringing the pressing grippers into their open position even at various length dimensions of the actually bar tacked buttonholes.

For cutting the buttonhole, in any case there must be chosen that moment at which the support plate does not move. The motion of the support plate is derived from one cam in the direction of the longitudinal axis of the buttonhole, and from a further cam in a direction transverse to said longitudinal axis of the buttonhole, the further cam being shaped in such manner that it is active only at the phase of bar tacking the eye at part $d_3$, $d_4$ of the wedge bar tack d of the buttonhole, and then in sections $d_5$, $d_6$ of the support plate dead zone. The first cam, that is that for inducing the action of the support plate in the direction of the longitudinal axis of the buttonhole, is shaped for cutting after bar tacking in such manner that it makes possible the stopping of the motion of the support plate for a transient interval in line $d_{10}$, i.e., still before the support plate reaches during the dead zone its extreme position $d_{11}$. This interval is sufficiently long for buttonhole cutting controlled by an independent cam coupled in its motion with a cam controlling the motion of the support plate in the direction of the longitudinal axis of the buttonhole, to take place at the time of stoppage of the support plate. Only upon the further continuation of the support plate in motion into the extreme position of the dead zone does the stop contact the end stop, and thus the pressing grippers are lifted into an inactive position. For this purpose, the stop is arranged adjustably in the direction of its motion toward the end stop cooperating therewith.

The disadvantage of such prior art device consists in the higher requirements for accuracy of adjustment of its parts, particularly for cutting after bar tacking. It is thus necessary to adjust the moment of lifting the pressing grippers on one side in such manner as to follow only after cutting the buttonhole, and on the other side in such manner as to precede the ending of the dead zone of the support plate, i.e. before reaching the level of line $d_{11}$, in which the driving pulley of the machine is disengaged from all further mechanisms of the machine.

Consequently, the lifting of the pressing grippers must take place in section $d_9$, which is considerably limited by the constructional requirements of the machine, and is e.g. 1 to 3 mms long. The adjustment relative to the moment of cutting is also determined by the angular position of the cam controlling the operation of the cutting mechanism. The adjustment relative to the moment of disengagement of the driving pulley of the machine from all further mechanisms is given by the angular position of a further cam which controls a clutch arranged between the driving pulley and its driven shaft. Thus it is necessary to perform adjustments, and moreover very sensitive ones, at two different points in the machine.

The present invention has among its objects the mitigation of the disadvantages of the prior art devices described above, and the provision of a control device in which upon transition from the adjustment of the machine for cutting before buttonhole bar tacking to a reversed sequence of operations a single element only must be adjusted, together with a reliable elimination, on the other hand, of the risk of lifting the pressing grippers too soon, i.e., before finishing the buttonhole cutting, as well as the risk that the grippers may not be lifted in time after cutting, i.e., before reaching line $d_{11}$, because thereafter no automatic lifting thereof takes place at all.

In accordance with a preferred embodiment of the invention, the control mechanism of the invention is incorporated in a buttonhole bar tacker sewing machine provided with a stitch forming mechanism comprising a needle, a cutting cam controlled by a device for cutting the buttonhole either before or after bar tacking, a support plate for the workpiece, a device for exerting a relative motion of the support plate relative to the longitudinal axis of the needle in a shape corresponding to the required shape of bar tacking the buttonhole, pressing grippers retaining the workpiece in their lowered position on the support plate, but not in their lifted position, and a device for stopping the machine upon completion of the buttonhole, all said devices operating automatically upon starting the machine. The control mechanism of the invention comprises on one hand a first disengaging member coupled with mechanism for lifting the pressing grippers, and on the other hand a second disengaging member coupled with a device for selectively starting and stopping the machine, said two disengaging members being disposed within the path of rotary motion of at least one section of at least one part mounted rotatably and coupled in the motion with a device for exerting a relative motion of the support plate of the workpiece relative to the longitudinal axis of the needle, as well as with the cutting cam.

An example in the form of a preferred embodiment of the buttonhole bar tacker sewing machine in accordance with the present invention is illustrated in the accompanying drawings, in which.

Figure 1:
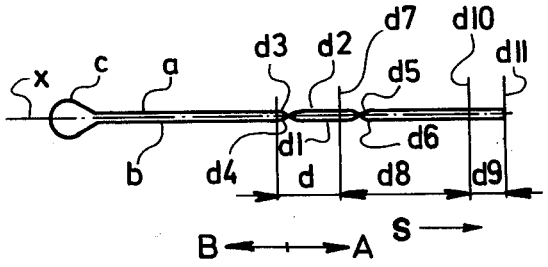
FIG. 1 is a diagram of a buttonhole, the separate parts of the buttonhole and the linked sections of motion of the support plate of the machine according to the present invention being illustrated in such figure.
Figure 2:
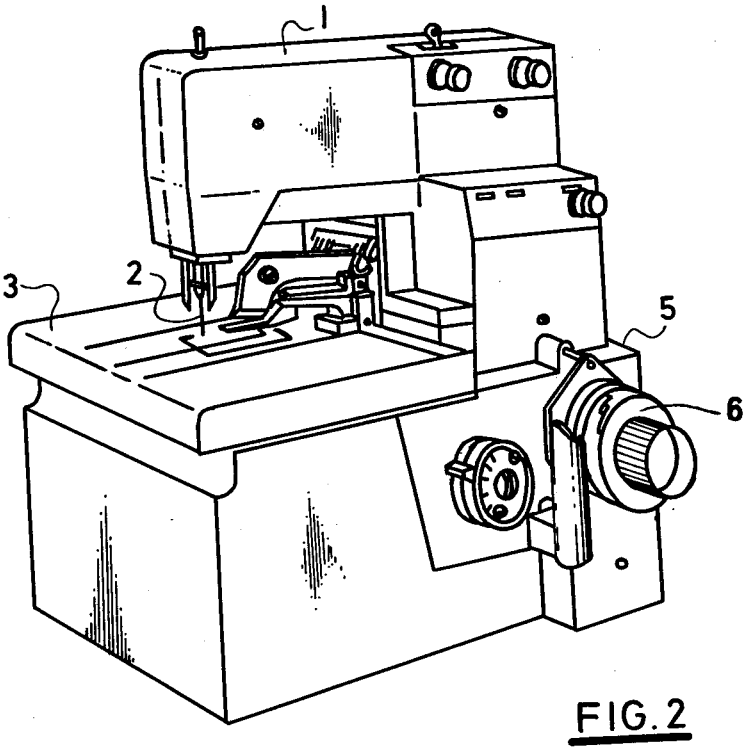
FIG. 2 is a view in axonometric projection of the illustrative embodiment of the machine according to the present invention.

Turning first to FIG. 2, there is there shown a buttonhole bar tacker sewing machine said machine having an overarm 1 in which there are mounted mechanisms, to be described below, which impart to the needle 2 a motion currently employed in conventional zigzag sewing machines. The machine is furthermore provided with a device known per se, by means of which the stitch forming mechanism is gradually turned at the phase of forming eye c of the buttonhole (FIG. 1) through an angle whose value is given by the required shape of the eye c of the buttonhole, usually to 180°. This device, which establishes the correct position of stitches in the eye c of the buttonhole, is of no importance for the correct operation of the present invention and is therefore neither described nor shown. The machine further comprises a support plate 3 to which the workpiece is fastened by pressing grippers generally designated 30 (FIG. 6) the arrangement and control of which is to be more fully described below, and a lower housing 5 the bottom of which is inserted in a sewing machine support (not shown). A pulley 6 forms the basic driving pulley for the whole machine, pulley 6 being connected by a belt (not shown) to a driving unit (not shown) such as an electric motor.

Figure 4:
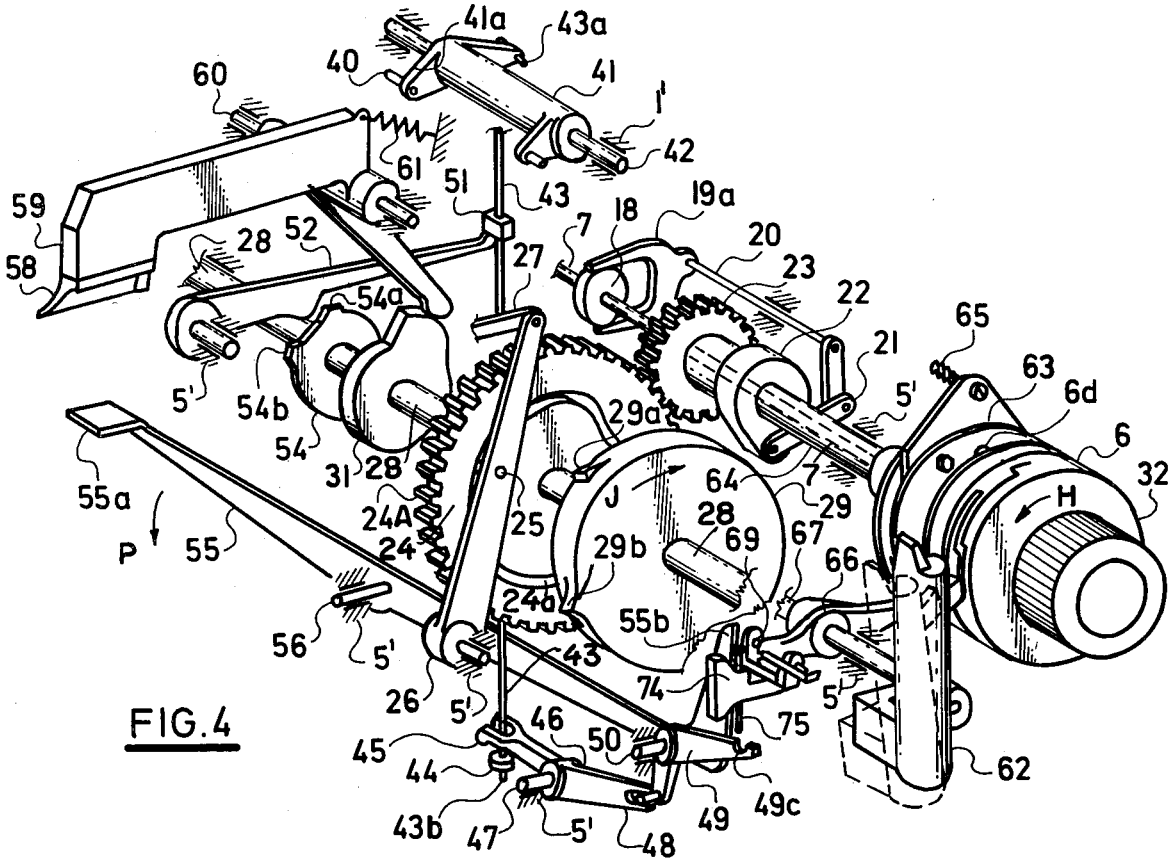
FIG. 4 is a view in axonometric projection of a part of the mechanisms of the machine according to the present invention.
Figure 3:
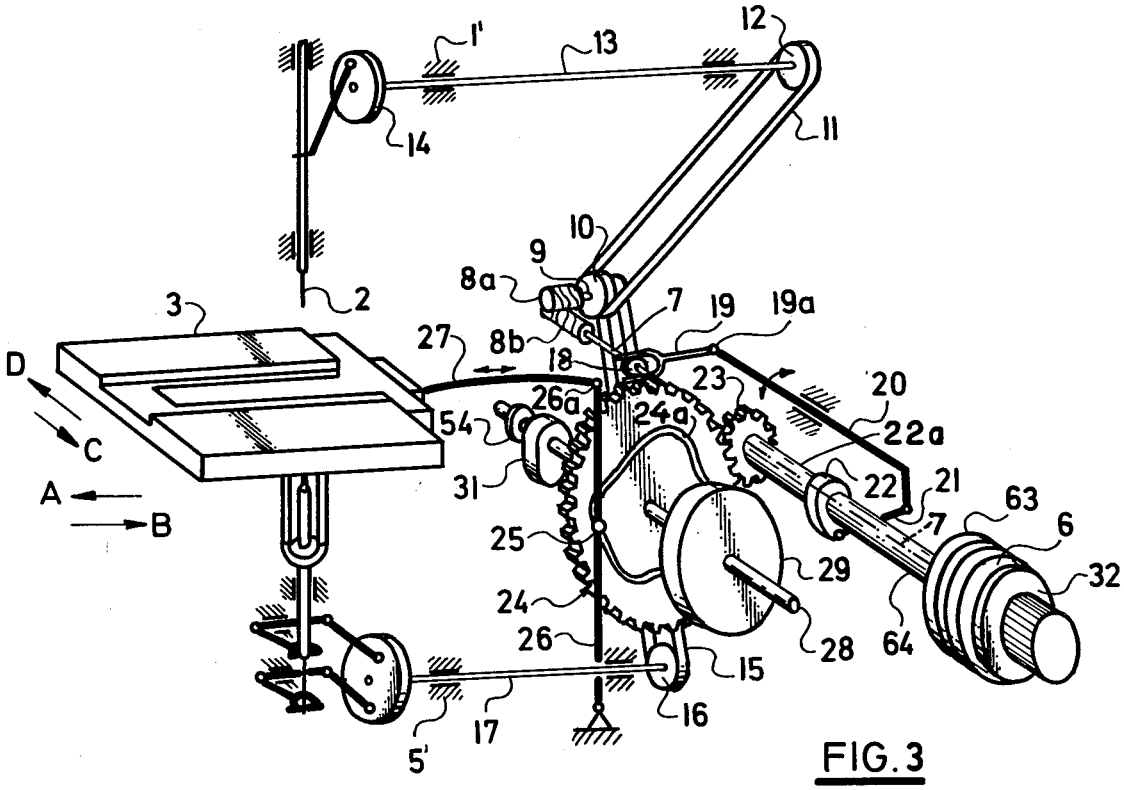
FIG. 3 is a fragmentary view in axonometric projection of the overall arrangement of the mechanisms of the machine according to the present invention.
Figures 8A, 8B, 8C, 8D:
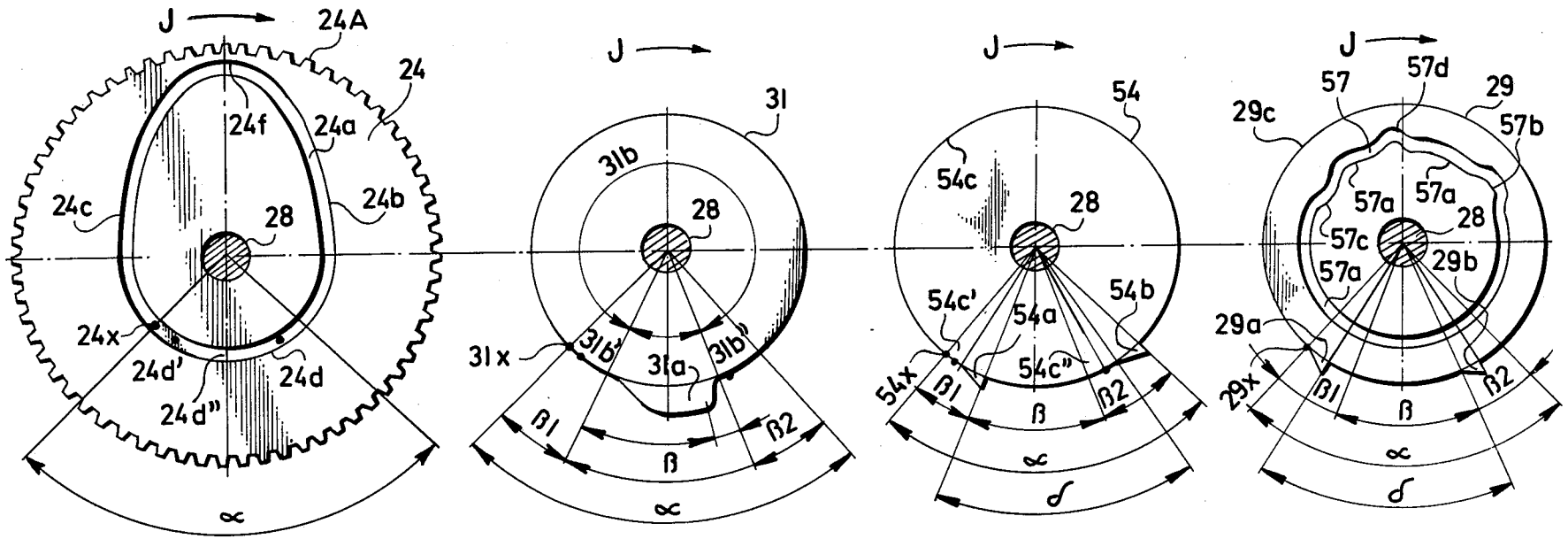
FIGS. 8*a*–8*d*, respectively, are views in elevation of four cams which are affixed to a common cam shaft, the views showing a singular position of the respective cams as related to the common cam shaft and thus to the cams themselves.

As shown in FIG. 3, the basic driving pulley 6 is fixed to a main shaft 7 of the sewing machine, shaft 7 being mounted in bearings (not shown) and is coupled in its motion through helical gears 8*a*, 8*b* to a countershaft 9, on which there is affixed a pulley 10. As shown in FIGS. 3 and 4, main shaft 7 runs through serially arranged hollow shafts of which the first is designated 64.

Pulley 10 is coupled by a belt 11 which extends to a pulley 12 fixedly mounted upon an transverse shaft 13 in the overarm 1, the shaft 13 being journalled in bearings of which one is shown at 1'. Fixedly connected to the forward end of the shaft 13 is an eccentric 14 which imparts a reverse vertical motion with a lateral component to the needle 2 by the eccentric 14, which is of conventional construction in zigzag sewing machines.

The pulley 10 is further connected by a belt 15 to a pulley 16 affixed to a lower horizontal driving shaft 17 which is journalled in bearings of which one is shown at 5'. Shaft 17 imparts a swinging motion to a gripper (not shown in FIG. 3) by a conventional driving means (not shown) said gripper thus participating with needle 2 in forming zigzag stitches. A three-sided cam 18 is affixed to main shaft 7, cam 18 being surrounded by a fork 19 the free end 19*a* of which is made as a part integral with a horizontal shaft 20 which is pivotally connected by a connecting link 21 with a tubular part 22*a* of an overrunning clutch 22. A gear 23 is formed integral with the rear end of the tube 22*a*, gear 23 being in a permanent engagement with the teeth 24A of a box cam 24 affixed to a cam shaft 28. One side face of the cam 24 is provided with a continuous cam groove in which there is permanently engaged a cam following pin 25 affixed to a lever 26 the lower end of which is pivotally mounted in the frame of the machine as shown at 5' in FIG. 4. The upper end 26*a* of lever 26 is pivotally connected to a tie rod 27 whch is in turn connected to support plate 3. As will appear more clearly from the further description of the device and its manner of operation, there is thus imparted to plate 3 the motion which is necessary for bar tacking the straight sides a, b of the buttonhole (FIG. 1).

A common cam shaft 28 carries not only the abovementioned cam 24, which, as we have seen reciprocates support plate 3 for the motion A⇄B (FIG. 1), but also a cutting cam 31, a closing cam 54, and a bar tacking cam 29. Such cams, which are shown in detail, respectively, in FIGS. 8*a*–8*d*, are all fixedly mounted upon the cam shaft 28 in the respective angular positions thereof shown in FIGS. 8*a*–8*d*, and rotate together in the direction J. The reference point 24*x* of cam 24, the reference point 31*x* of cam 31, the reference point 54*x* of cam 54, and the reference point 29*x* of cam 29 all lie at the angle $\frac{1}{2}\alpha$ to the left of vertical in the respective FIGS. 8*a*–8*d*.

The box cam 24 comprises on the one hand a cylindrical surface concentric to the axis of shaft 28, and is provided with teeth 24A which are in permanent mesh with gear 23. On the other hand, the cam 24 bears a cam groove 24*a*, which comprises the following sections: circular section 24*d*, arranged concentrically relative to the axis of shaft 28 and extending through an angle of $\alpha$, which is for example 90°, an ascending section 24*b*, the distance from the axis of rotation of shaft 28 gradually increases until the top 24*f*, where it is at its maximum, and a descending section 24*c*, of which the distance from top 24*f* gradually decreases as far as the continuing part of circular section 24*d*.

The cutting cam 31 has the shape of a cylinder 31*b* which is arranged concentrically with respect to the axis of the shaft 28 with a projection 31*a*, having an ascending part 31*c*, and a descending part 31*d*. The angular value $\beta$ of the whole projection 31*a* is smaller than the angular value $\alpha$ of the circular section 24*d* of groove 24*a* of box cam 24 the sum of sections $\beta_1$, $\beta_2$, which can be, for example, 24°, having equally distributed on either side of the projection 31*a*.

The closing cam 54 has a cylindrical shape 54*c*, arranged concentrically relative to the axis of shaft 28, with two projections 54*a*, 54*b* which are situated within sections $\beta_1$, $\beta_2$. The angular value of each of said projections 54*a*, 54*b* is for example 6°. A general rule is that the angular value of projection 54*a* must be smaller than angle $\beta_1$, and similarly the angular value of projection 54*b* must be smaller than angle $\beta_2$. As will follow from the further description below, the device will operate correctly even in that case in which section $\beta_1$ has a not exactly cylindrical shape, but rather a slightly descending one.

Bar tacking cam 29 comprises on one hand a cylindrical surface 29*c*, on which there are disposed two mutually laterally offset projections 29*a*, 29*b* and on the other hand the cam groove denoted as a whole by reference character 57. Projections 29*a*, 29*b* may be disposed at approximately the same values of angles as projections 24*a*, 24*b*, i.e. 6°. The cam groove 57 consists of a circular section 57*a* which is interrupted on one side by section 57*d* for bar tacking eye c of the buttonhole (FIG. 1) and on the other side by two sections 57*b*, 57*c*, which are intended for the lateral displacement of support plate 3 perpendicular to the direction of the longitudinal axis x of the buttonhole. Thus the cam groove 57 imparts a lateral displacement to the support plate 3 which is in the directions D, C shown in FIG. 3. All three sections 57*b*, 57*c*, 57*d* are not important for the operation of the device according to the present invention, and are shown only for the purpose of facilitating the description and the further part of the specification of the operation of the machine according to the present invention, and also in relation to the separate phases of bar tacking the buttonhole. Projection 29*a* is situated in the direction of rotation J of shaft 28 in front of projection 54*a*, projection 29*b* similarly being in front of projection 54*b*. It is evident from the drawing that the projection 31*a* of the cutting cam 31 of an angular value $\beta$ is situated inside angle $\alpha$ between the end of projection 54*a* and the beginning of projection 54*b* of closing cam 54 and is inside angle $\delta$ between the end of projection 54*a* and the beginning of projection 54*b* of closing cam 54 and inside angle $\delta$ between the end of projection 29*a* and the beginning of projection 29*b* of the bar tacking cam 29.

The machine is further provided with a device for starting and stopping the stitch forming mechanism of the machine, which in a known manner holds both the driving and driven part of a clutch (not shown) in engaged or disengaged condition, said clutch being mounted in the free pulley 6, on the one hand, and the main shaft 7 on the other, and thus maintains or interrupts the driving connection between, on the one hand said free pulley 6 and the main shaft 7 and the mechanisms attached thereto on the other hand, thus defining the level of line $d_7$ (FIG. 1) on which the operation of the stitch forming mechanism is finished and the dead travel of support plate 3 after finishing the buttonhole is begun.

The machine is further provided with a device which is also known, for securing the rapid traverse of the support plate 3 in the phase of its dead travel from line $d_7$ in th direction of arrow B, by which the longitudinal axis of the needle is displaced to level $d_{10}$.

As will follow from the following description, the machine according to the present invention does not necessitate an intermediate rest position of the support plate 3 before reaching its initial position for bar tacking the following buttonhole, the position in line $d_{10}$ thus being the initial position of the machine. The device is operated synchronously with the disengagement of the driving connection between the free pulley 6 and the main shaft 7 in a manner which is now to be described.

As has been described above, the device comprises a free pulley 6 which is constantly driven in the direction of arrow H (FIG. 4) from an electric motor (not shown). In the right front wall of the pulley 6 there is provided a recess in the form of a flat cylinder concentric to the axis of rotation of pulley 6. On the main shaft 7 there is affixed a hand wheel 32. In the wall which is adjacent to the front wall of pulley 6 there is affixed a known, one-direction roller clutch, which is not shown in the drawings including FIG. 4, and which positively drives both the shaft 7 and the hand wheel 32 except for when the shaft and hand wheel are in their rest position. during bar tacking the buttonhole, said roller clutch is in engagement with recess **6*d* of free pulley 6, the rotary motion of which is thus positively imparted to the roller clutch and thus also to hand wheel 32 and main shaft 7. The driving connection between the free pulley 6 and the roller clutch is disengaged in a known manner by the action of a lever 62, which is part of the device for starting and stopping the stitch forming mechanism, by displacing said lever from the position thereof shown in dash lines in FIG. 4 to the position shown in full lines. The motion of lever 62 is derived in a known manner from the motion of support plate 3 and is synchronized therewith in such manner that disengagement of the driving connection between the free pulley 6 and the hand wheel 32** takes place at the required level of line $d_{10}$.

As the position of the line $d_7$ is changed upon changing the buttonhole length only within a range which does not reach as far as line $d_{10}$ which is within the range of the dead travel phase of support plate 3 in any case, the adjustment of the buttonhole length does not require the necessity of re-adjusting the phase, in which the pressing grippers generally designated 30 are lifted into their inactive position, and which takes place always in the position given by line $d_{10}$.

On the other side of the free pulley 6 there is provided an entraining projection **6*d*, which is arranged, during operation of the stitch forming mechanism at a distance in view of the entraining pin of the rapid traverse cylinder 63, displaceably, however, fixed in the direction of rotation on the above-mentioned hollow shaft 64, which is longitudinally grooved, shaft 64 being mounted rotatably in bearings not shown in the housing 5 of the machine; shaft 64 forms one of the bearings of main shaft 7, the other bearing of which is provided in housing 5 of the machine. The two shafts 7, 64** are arranged so as to be independent of each other in their rotary motion, in the direction of arrow H.

By moving lever 62 into the position shown in full lines in FIG. 4, whereby the driving action between the basic driving pulley 6 and the hand wheel 32 is disengaged, a driving connection is simultaneously formed between free pulley 6 or the projection **6*d*, and an entrained pin of the rapid traverse disc 63 in a manner which is currently known and practically applied in all heretofore produced machines for bar tacking buttonholes. Therefore such mechanism is not described here in a detailed manner other than to say that the rapid traverse disc 63 here displaced upon the action of the compression spring 65 toward the free pulley 6, which is possible only upon displacing lever 62 into the position thereof shown in full lines in FIG. 4, as the elements which are coupled in their motion with lever 62, but are not shown, maintain the rapid traverse disc 63 at a distance from the free pulley 6 as long as lever 62 is in its dash-line position in FIG. 4**.

The rapid traverse disc 63 is now given a rotary motion from free pulley 6 in the direction of the arrow H such rotary motion being transmitted to the hollow grooved shaft 64 and by this to gear 23 fixed on hollow splined shaft 64. As seen above, the gear 23 is in permanent mesh with the teeth 24A on the cam 24, and shaft 28 to which it is affixed, are thus driven in the direction of the arrow J (FIG. 4). As above noted, the cutting cam 31, the bar tacking cam 29, and the closing cam 54, affixed to shaft 28, are rotated therewith. As disclosed above, two projections **29*a* and 29*b* are provided on a circumference of bar tacking cam 29, such projections cooperating with a device for lifting the presser grippers 30** into an inoperative position.

Figure 5:
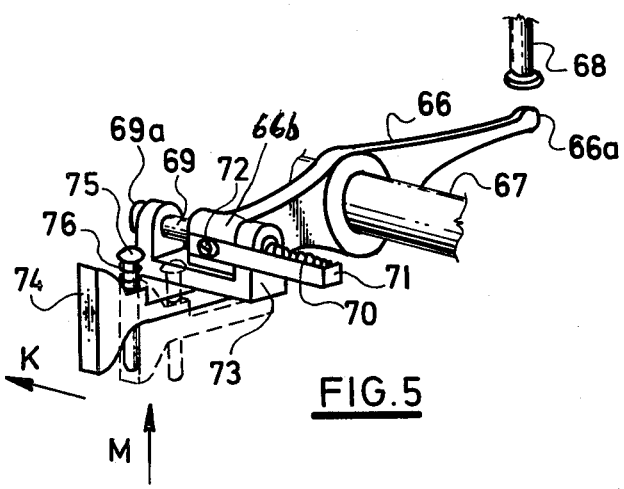
FIG. 5 is a fragmentary view in axonometric projection of another part of the machine according to the present invention.

Such device, which is now to be described in detail, is shown in FIGS. 4 and 5. This device consists of a two-armed lever 66 pivotally mounted on pin 67, on which there is also mounted the previously described lever 62. Against one end **66*a* of the said two armed lever 62 bears one end of a strutting bar 68 intended for disengaging the driving connection between free pulley 6 and rapid traverse disc 63, as will be described below. The other end 66*b* of two armed lever 66 is made in the form of a cylinder, in which an opening is made, the axis of which is parallel to the axis of the pin 67, and into which there is inserted a traversable pin 69 which is mounted traversably in the direction of the longitudinal axis and secured against falling out at one of its ends by a headpiece 69*a*, and at the other end by a securing ring (not shown). Against that other end permanently bears one end of a compression spring 70, which bears with its other end against a support 71 formed by a bracket fixed to end 66*b* by screw 72. The compression spring thus maintains the traversable pin 69 in its extreme position in the direction of arrow K, FIG. 5. The traverse motion of traversable pin 69 is positively participated in by holder 73, which is fixed therewith. With the holder 73 there are connected adjustably in the direction of arrow K, a disengaging tooth 74 which positively participates in the motion and the rest position of holder 73, the function of which is to be described later. The adjustability of disengaging tooth 74 relative to holder 73 is secured in such manner that the holder 73 is made in the form of a guideway in a known manner (not shown), on which the depositing part of the disengaging tooth 74 is mounted slidably in the direction of arrow K, FIG. 5, and can be fixed by a screw (not shown) inserted in a threaded opening made in holder 73 and passing through a groove made in the depositing part of the disengaging tooth 74 and also directed in the direction of arrow K, FIG. 5**.

In the passage, in the body of disengaging tooth 74, there is further mounted a disengaging pin 75, which positively participates in the adjusted position of disengaging tooth 74 in the view of holder 73 in the direction of arrow K. This disengaging pin 75 is steadily pressed by compression spring 76 into its extreme position in the direction of arrow M, said spring bearing on one hand against the lower part of its head, and on the other hand against the body of the disengaging tooth 74, said extreme position being defined by its extended lower end, by which it is retained at the border of the opening in which it is located.

Upon operation of the machine, the disengaging pin 75 is normally in its extreme position in the direction of arrow M. Only at that phase at which either of the projections 29*a*, 29*b* of the bar tacking cam 29 contacts said pin, it is displaced against the action of compression spring 76 against the direction of arrow M, thus causing a lifting of the pressing grippers 30, as will be now described with reference to FIG. 6.

Figure 6:
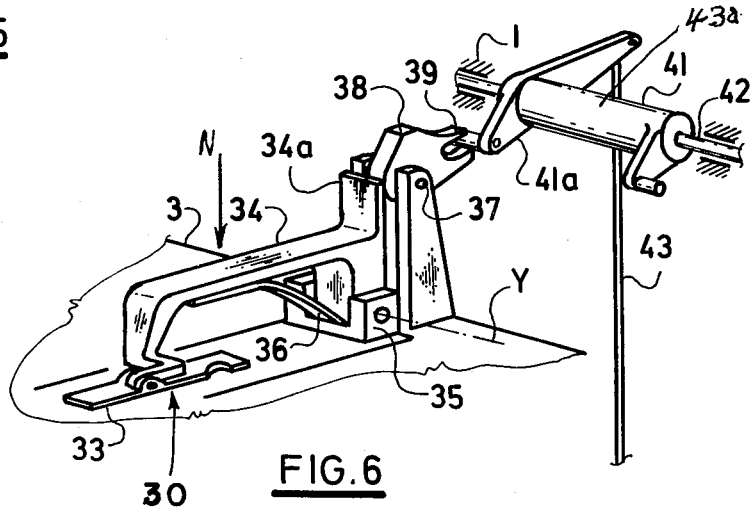
FIG. 6 is a fragmentary view in axonometric projection of a part of the device for controlling the motion of the pressing grippers of the machine according to the present invention.

Both pressing grippers 30 of which only one is represented in FIG. 6, are of the same mirror image construction. The pressing gripper 30 comprises the actual pressing plate 33 mounted swingably on a holder 34, which is mounted swingably about axis Y in angle 35, which is connected firmly, e.g. by screws, with support plate 3. A leaf spring 36 is mounted from downside to holder 34, said spring bearing with one end against angle 35 and beng arranged in such manner that it tends to depress holder 34 with pressing plate 33 in the direction of arrow N, FIG. 6. On pin 37, fixed in a lug (not shown) of the support plate 3 there is swingably mounted a pressing cam 38 made as one piece with a fork 39, which is engaged only upon reaching the initial position given by line $d_{10}$by the support plate 3 by pin 42, which is inserted in the arm 41 into overarm 1 of the machine.

Figure 7:
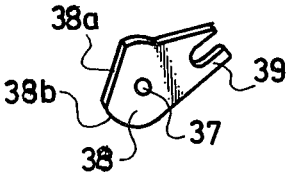
FIG. 7 is a fragmentary view on an enlarged scale in axonometric projection of a part of the device shown in FIG. 6.

The pressing cam 38 as shown in FIG. 7 comprises on one hand a straight part 38*a*, and on the other hand two curvilinear parts, of which the active one only is denoted 38*b*. When the straight part 38*a* of the pressing cam 38 bears against the end 34*a* of holder 34, the pressing grippers 30 are in their inactive, i.e. their lifted position. As soon as end 34*a* is contacted by curvilinear part 38*b*, the holder 34 is displaced in such manner that the pressing grippers 30, or their pressing plates 33, are lowered onto the support plate 3 as far as the position in which they grip reliably and thereby fix the position of the inserted workpiece. The other arm 41*b* of two-armed lever 41*a* is provided with an opening, into which one end 43*a* of tie rod 43 is inserted, the other end thereof 43*b* being provided with a ring 44, which is fixed thereto by a screw (not shown) and the diameter of which is larger than the inner dimension of fork 45, which surrounds the other end 43*b* of tie rod 43 and is made in the form of one arm of a two-armed lever 46, mounted swingably on pin 47 fixed to housing 5 of the machine. The other arm of this two armed-lever 46 is made in the form of a fork 48, into which the first end 49*a* of a further two-armed lever 49 is inserted, which is mounted on pin 50, which is also fixed inside the housing 5 of the machine. The other end 49 of two-armed lever 49 is intended for scanning the motion of disengaging pin 75 oppositely to the direction of arrow M. The recess 49*c* made in the other end 49*b* of two-armed lever 49 does not serve the purpose of the present invention, but makes possible for the attendant, in cooperation with a further (here not described) mechanism of the machine to make inactive the device for lifting the pressing grippers 30, particularly upon thread breakage during bar tacking of an already cut buttonhole, by displacing the displaceable pin 69 into a intermediate position between its two extreme positions, in which the disengaging pin 75 penetrates a recess 49*c* upon motion in a direction opposite to arrow M and thus does not cause any change in position of two-armed lever 49 nor the transmission elements attached thereto which have already been described. As follows from the specified arrangement, lifting of pressing grippers 30 into an inactive position is caused by the motion of disengaging in 75 in a direction opposite to arrow M and its contact of arm 49*b* of two-armed lever 49 in the remaining cases.

For displacing the pressing grippers 30 back into their active, i.e. for putting them down in the workpiece, a further mechanism of the machine is employed. On tie rod 43, a cube 51 is fixed by means of a screw, said cube cooperating with a one-armed lever 52 mounted on pin 53 fixed in housing 5 of the machine. A swinging motion of the one-armed lever 52 is derived from a rotary motion of the closing cam 54 fixed on shaft 38, in the course of which projection 54*a* and projection 54 *b* of closing cam 54 gradually contact the one-armed lever 52, to which there is thus imparted a swinging motion in the direction of arrow P, FIG. 4. Via the members described above, to the pressing grippers 230 there is thus imparted a motion against the direction of arrow N, by which grippers 30, or their pressing plates 33, respectively, bear against the support plate 3 or the workpiece material deposited thereon.

The machine is further provided with a manually controllable two-armed starting lever 55, one end 55*a* of which is extended outside the machine, while its other end 55*b* bears against a displaceable pin 69, which can be displaced by motion of end 55*a* substantially in the direction of arrow P about pin 56 in housing 5 of the machine, into its extreme position in a direction opposite to that of arrow K.

The described device is mounted in a machine which is adjusted for cutting the buttonhole before bar tacking, in the following manner:

In the initial position of the machine, the displaceable pin 69 is located in its extreme position in the direction of arrow K, that is, at its left extreme position. The disengaging tooth 74 are in engagement with projection 29*a* of bar tacking cam 29. Thus, the rapid traverse disc 63 is displaced from the rest condition of the device into a position out of engagement with projection 6*d* of free pulley 6. Lever 62 is in the position shown in full lines in FIG. 4 in which it prevents driving engagement between recess 6*b* of free pulley 6 and the clutch in handwheel 32. The rotary motion of free pulley 6 thus is not transmitted to further mechanisms of the machine.

The support plate 3 is in a position corresponding to line $d_{10}$ (FIG. 1); said plate was brought into this position at the end of the bar tacking of the preceding buttonhole, when projection 29*a* contacted the disengaging tooth 74, whereby the rapid traverse disc 63 was disengaged from free pulley 6, pin 25 of lever 26 is in engagement with point 24*d*' which is already situated in the circular section 24*d* of cam groove 24*a*. This position (line $d_{10}$) is maintained by support plate 3 for the whole time during which pin 25 is in engagement with any point of the circular section 24*d* of cam groove 24*a*.

The end of cutting lever 59 bears against point 31*b*' of cutting cam 31, situated in angular section $\beta_1$. The one-armed lever 52, which forms a part of the mechanism for lowering the pressing grippers onto support plate 3, bears against point 54c', situated immediately before the beginning of projection 54a of closing cam 54, when looked at in the direction of rotation J of shaft 28. In the initial position of the machine, projection 29a bears against disengaging tooth 74, but no longer bears against disengaging pin 75, which is thus in its extreme upper position in the direction of arrow M. The disengaging tooth 74 are displaced by engagement with projection 29a into such a position that driving engagement between free pulley 6 and rapid traverse disc 63 is impossible. The disposition of disengaging pin 75 out of range of projection 29a only serves the purpose of making possible the manual opening and closing of the pressing grippers 30. For the actual function of the machine, even an arrangement would be suitable in which at the initial position of the machine, both the disengaging tooth 74 as well as the disengaging pin 75 would be in engagement with projection 29a.

When now the end 55a of the starting lever 55 is manually displaced substantially in the direction of arrow P, the following action takes place:

By motion of end 55b of starting lever 55, displaceable pin 69 is displaced opposite the direction of arrow K, i.e. into its right extreme position. This motion of the displaceable pin 69 is positively participated in by disengaging pin 75 as well as disengaging tooth 74, which are thus displaced out of engagement with projection 29a of bar tacking cam 29, and thus makes possible to turn said cam into such position that the disengaging teeth 74 do not prevent the bar tacking cam 29 from further rotary motion, not even upon the returning of the disengaging tooth 74 in the direction of arrow K, into its original position, which takes place by action of the compression spring 70 upon release of the starting lever 55. By cancelling the engagement between the projection 29a of bar tacking cam 29 and the disengaging teeth 74, the two-armed lever 66 is enabled to swing out in such manner that the disengaging tooth 74 approach the cylindrical part 29c of the bar tacking cam 29. This swinging motion of the two-armed lever 66 is exerted via the mechanisms described above by compression spring 65, which was retained before via said mechanisms in a position in which said spring could not previously push the rapid traverse disc 63 into engagement with free pulley 6, this being possible only now. Thus, the rapid traverse disc 63 is brought into motion and via hollow splined shaft 64 and the gear 23 fixed thereon, of which the teeth are in engagement with teeth 24a of box cam 24 fixed on shaft 28, by the rotary motion of which the cutting cam 31, closing cam 54 and bar tacking cam 29 are also driven.

Upon rotation of closing cam 54, in the direction of arrow J, its projection 54a contacts the one-armed lever 52 and thus causes a displacement of the pressing plates 33 of the pressing grippers 30 opposite the direction of arrow N, i.e. they press upon the workpiece laid on the support plate 3. By rotation of the pressing cam 38, the pressing grippers 30 remain lowered even upon disengagement of projection 54a from one-armed lever 52 by continuing rotary motion of closing cam 54. Thereupon, projection 31a of cutting cam 31 contacts cutting lever 59 and causes the cutting of the workpiece, retained by pressing grippers 30, by cutting knife 58. Upon continuing rotary motion of cutting cam 31, its projection 31a comes out of engagement with cutting lever 59, which is enabled in such manner to be displaced by the action of tension spring 61 into a position, which corresponds to the inactive, lifted position of cutting knife 58. At the moment of cutting the workpiece by cutting knife 58, circular section 24b of the groove of cam 24 is still in engagement with pin 25 of lever 26, the support plate 3 is thus not being imparted a motion in the direction of arrow A, FIG. 3. The bar tacking cam 29 also does not, at this phase, impart to the support plate 3 a motion perpendicular to the direction of longitudinal axis x of the buttonhole, as circular part 57a of groove 57 bears against a linked mechanism (not shown), the cutting of the workpiece by cutting knife 58 thus actually taking place upon the stopping of the support plate 3. It will be seen that upon the continued rotary motion of grooved cam 24, pin 25 of lever 26 contacts the beginning of the ascending section 24b of its groove 24a, the support plate 3 is given a motion in the direction of arrow A, FIG. 3, which takes place upon reaching line $d_7$, FIG. 1, by rapid traverse as described above. Even before reaching line $d_7$, the support plate 3 is displaced along line $d_6$ (FIG. 1) by the action of projection 57b of groove 57 of bar tacking cam 29 and the ascending part 24b of groove 24a of box cam 24, into a lateral position necessary for bar tacking the straight part $d_1$ of wedge bar tack d of the buttonhole. This, however, is not necessary for the operation of the device according to the present invention.

Upon reaching line $d_7$, the stitch forming mechanism is brought into action in the manner described above; the machine is also brought by rapid traverse to a velocity necessary for bar tacking the buttonhole, i.e. gradually at first the straight part $d_1$, the inclined section $d_3$ of wedge bar tack d, and straight part a of the buttonhole, of which the bar tacking is finished at the moment at which top 24f of groove 24a of grooved cam 24 contacts pin 25 of lever 26. At this moment, a known mechanism (not shown), which does not form a part of this application, causes a turning of the stitch forming mechanism through 180° into a position necessary for bar tacking the other straight part b of the buttonhole, the inclined section $d_4$ and the straight section $d_2$ of wedge bar tack d of the buttonhole. Upon again reaching section $d_7$, the stitch forming mechanism is disengaged from operation in the above described manner and the machine is set into rapid traverse, by which it travels from line $d_7$ to line $d_{10}$, at which time pin 25 of lever 36 is contacted by circular part 24d of the groove 24a of grooved cam 24. Thus the motion of the support plate 3 in the direction of arrow B, (FIG. 3) is stopped. Shortly thereafter, projection 29a of bar tacking cam 29 contacts disengaging pin 75, displaces it against the direction of arrow M (FIG. 5) and, in the manner described above, lifts the pressing grippers 30 into inactive position, immediately thereafter, in the course of further continuing rotary motion of bar tacking cam 29, projection 29a of bar tacking cam 29 contacts disengaging tooth 74, the rapid traverse disc 63 thus being displaced via the mechanisms described above out of engagement with free pulley 6 which is now disconnected by lever 62 also from the manual wheel 32, so that the motion of free pulley 6 is not transmitted to any further element of the machine, which is stopped, after a short inertial run-out, shortened by a braking mechanism (not shown). The machine is now in its initial position for bar tacking a further buttonhole, which can be started after the appurtenant displacement of the workpiece.

If it is necessary to adjust from cutting before bar tacking to cutting thereafter, the driving electric motor (not shown) is switched off at first and the free pulley 6 is allowed to run out. Thereupon the disengaging tooth 74 are displaced by motion opposite the direction of arrow K from the full line position (FIG. 5) to a position represented there in dash lines, and adjusted in that position. At that position, the disengaging tooth 74 is out of engagement with projection 29*a;* however, it is situated in the path of movement of a laterally displaced second projection 29*b* of the bar tacking cam 29. Thereupon, the driving electric motor is started again, and thus activated without any further control steps the rapid traverse disc 63, which was brought into driving engagement with free pulley 6 since the disengaging tooth 74 were displaced and adjusted in such position that they are out of engagement with projection 29*a* of bar tacking cam 29. Thus the shaft 28 is activated via the mechanisms described above and rotates as long as disengaging tooth 74 will contact projection 29*b* of bar tacking cam 29 whereby in final consequence, the free pulley 6 is again out of engagement with the clutch of handwheel 32. By reaching this angular position of shaft 29, pin 25 of lever 26 is brought into engagement with point 24*d*" of the circular section 24*d* of groove 24*a* of grooved cam 24. The cutting cam 34 is displaced into a position, in which point 31*b*" is in contact with cutting lever 59, so that cutting lever 59 travels during this motion of cutting cam 31 about its projection 31*a* and the cutting motion of cutting knife 38 is performed. It follows therefrom, that this adjustment from cutting before bar tacking to cutting after bar tacking the buttonhole may be suitably performed without the presence of the workpiece on the support plate 3. Analogously, upon rotary motion of closing cam 54, the one-armed lever 52 travels about projection 54*a* of closing cam 54, whereby the pressing grippers 30 are lowered on the support plate 3 and remain in this position during cutting. They are lifted only then when the disengaging pin 75 is contacted by projection 29*b* of bar tacking cam 29. Shortly thereafter, projection 29*b* of bar tacking cam 29 contacts disengaging tooth 74 and stops the machine in a position in which point 54*c*", situated in the direction of rotation J of closing cam 54 immediately in front of its projection 54*b*, is in engagement therewith.

If now by swinging the starting lever 55 substantially in the direction of arrow P, FIG. 4, the machine is started, an action similar to that described in connection with the preceding adjustment of the machine takes place with the following differences:

The function formerly performed by projection 54*a* of closing cam 54 is now performed by its second projection 54*b*. The changed angular position of the cutting cam 31 causes the cutting of the buttonhole to take place only when cutting lever 59 upon following the whole circular section 31*b* of cutting cam 31 again contacts projection 31*a*.

The function of projection 29*a* of the closing cam 29 is taken over by projection 29*b* of the bar tacking cam 29, as the disengaging teeth 74, upon displacement and adjustment into its new position as described above is situated apart from the path of movement of projection 29*a* in a manner similar to that in which it was previously spaced from the path of movement of projection 29*b*.

As the mutual angular position of cams 24, 29, 31 and 54 remains, even upon adjustment for cutting the buttonhole after its bar tacking, without change, no incorrect sequence of the separate steps can take place, e.g. lifting the pressing grippers 30 before cutting the buttonhole or stopping the machine before lifting the pressing grippers 30, or possibly even before cutting the buttonhole.

The described embodiment of the apparatus of the invention admits numerous variations. Thus it is not necessary that projections 29*a*, 29*b* which are intended for controlling disengaging pin 75 and disengaging tooth 74, to be arranged on one and the same cam 29. It is also not necessary that the disengaging pin 75 be controlled by the same projection (29*a*, or possibly 29*b*) as the disengaging tooth 74, it is only the time sequence in which said elements are controlled that is essential. Thus disengaging pin 75 could be located e.g. at the other end of the shaft 28 and could be controlled by a (not shown) projection of a cam (not shown) while maintaining the time sequence relative to controlling the disengaging tooth 74, the machine will operate in the required manner. It is also not necessary to employ two projections, i.e. 29*a*, 29*b* on cam 29. A single cam is sufficient if angular adjustability relative to cutting cam 31 and groove 24*a* of grooved cam 24 were provided, whether by angular adjustability of the cam 29 as such on shaft 28, or by angular adjustability of the projection on cam 29. It is not necessary that this projection or projections 29*a*, 29*b* were disposed just on bar tacking cam 29, and it is not necessary to make them in the form of projections on a cam, as the remaining part of its cylindrical surface has no function in relation to the disengaging pin 75, as well as the disengaging tooth 74. In the embodiment with two projections 29*a*, 29*b* which are mutually laterally offset, i.e. offset in the direction of the axis of shaft 28, it would also not be necessary to arrange adjustably in that direction either disengaging pin 75 or disengaging tooth 74, if cam 29 as such were arranged adjustably in that direction on which these two projections 29*a*, 29*b* are made. Said projections 29*a*, 29*b* therefore can be formed as the end of two bars or generally any parts shaped in such manner that their remaining sections will not act on disengaging pin 75 or disengaging tooth 74. Similarly, the disengaging pin 75 itself and the disengaging tooth 74 are only an example of one of many possible embodiments of disengaging parts.

Machines are known for bar tacking buttonholes, in which the support plate 3 is arranged relative to the support of the machine stationarily, and in which the relative motion between the support plate 3 and the stitch forming mechanism comprising a needle is exerted by the motion of the machine head, in which the stitch forming mechanism is arranged. With this arrangement, a motion is imparted from the grooved cam 24 and the bar tacking cam 29 not to the support plate 3, but to the machine head. The arrangement according to the present invention can be applied without undue difficulty to these machines.

From the function as described above there also follow admissible variations in the shape of the separate cams from the specified exemplary embodiment. Thus angular section $\beta_1$ of cutting cam 31 can have in the direction towards projection 31*a* a slightly ascending course, by which the cutting knife 58 will begin to swing out in the direction towards the workpiece, as only by the top part of projection 31*a* of cutting cam 31 is there defined the effective cutting position of the cutting knife 58. Other variations are not described in a more detailed manner, but are comprised within the scope of the present invention as defined in the appended claims.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a buttonhole bar tacker sewing machine having a stitch forming mechanism including a needle, a cutting cam controlled by a device for selectively cutting the buttonhole either before or after bar tacking, a support plate for the workpiece, a device for exerting a motion of the support plate relative to the longitudinal axis of the needle in a shape corresponding to the required shape of bar tacking the buttonhole, pressing grippers which when lowered retain the workpiece in their gripping position on the support plate, and a device for stopping the machine upon completion of the buttonhole, all said devices operating automatically upon starting the machine, the improvement which comprises a first disengaging member coupled with mechanism for lifting the pressing grippers, a second disengaging member coupled with a device for selectively starting and stopping the machine, said two disengaging members being situated within the path of rotary motion of at least one section of at least one part mounted rotatably and coupled in its motion with the device for exerting a relative motion of the support plate of the workpiece relative to the longitudinal axis of the needle as well as with the cutting cam.

2. A buttonhole bar tacker sewing machine as claimed in claim 1, wherein the first disengaging member and the second disengaging member are situated within the path of motion of two mutually angularly and laterally offset sections of said one part mounted rotatably and coupled in its motion with the device for exerting a relative motion of the support plate.

3. A buttonhole bar tacker sewing machine as claimed in claim 1, wherein one of the mutually angularly and laterally offset sections of the said one part is arranged angularly displaceably and adjustable relative to the cutting cam.

4. A buttonhole bar tacker sewing machine as claimed in claim 1, wherein the first disengaging member and the second disengaging member are situated within the path of motion of two sections of two different parts mutually coupled in their motion.

5. A buttonhole bar tacker sewing machine as claimed in claim 1, wherein the machine has a starting lever extending from the machine body, and the second disengaging member is coupled in its motion with the starting lever.

* * * * *